United States Patent [19]

O'Link

[11] 4,038,713

[45] * Aug. 2, 1977

[54] PERSONAL FLOTATION DEVICE

[75] Inventor: Maurice H. O'Link, St. Cloud, Minn.

[73] Assignee: Stearns Manufacturing Company, St. Cloud, Minn.

[ * ] Notice: The portion of the term of this patent subsequent to May 18, 1993, has been disclaimed.

[21] Appl. No.: 668,592

[22] Filed: Mar. 19, 1976

Related U.S. Application Data

[63] Continuation-in-part of Ser. No. 543,407, Jan. 23, 1975, Pat. No. 3,956,786.

[51] Int. Cl.[2] ..... B63C 9/10

[52] U.S. Cl. ..... 9/345

[58] Field of Search ..... 9/329, 333, 336–340, 9/342, 345

[56] References Cited

U.S. PATENT DOCUMENTS

| | | | |
|---|---|---|---|
| 2,563,966 | 8/1951 | Shaw | 9/342 |
| 3,181,183 | 5/1965 | Allen | 9/333 |
| 3,400,415 | 9/1968 | Scheurer | 9/342 |
| 3,956,786 | 5/1976 | O'Link | 9/345 |

*Primary Examiner*—Stephen G. Kunin
*Assistant Examiner*—Stuart M. Goldstein
*Attorney, Agent, or Firm*—Merchant, Gould, Smith, Edell, Welter & Schmidt

[57] ABSTRACT

A personal flotation device having a buoyant collar, a front bib section containing a flotation element and a back member, the bib and back members having lower portions that may be overlapped so as to cooperate with the collar to define armholes, the collar having a central opening for the neck of the wearer. The collar comprises front and rear collar sections pivotally secured together on an axis extending diametrically of the neck receiving opening and transversely of the device.

5 Claims, 5 Drawing Figures

FIG. 1
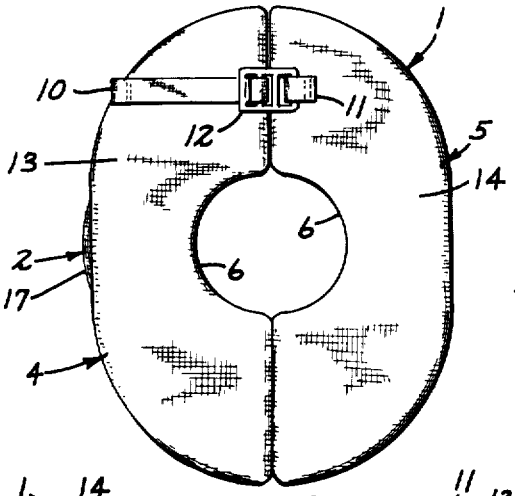
FIG. 2
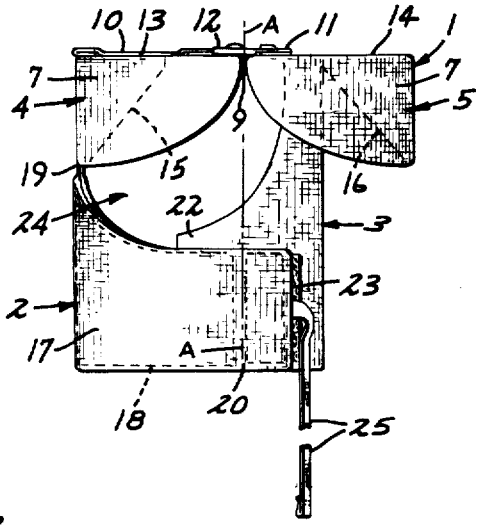
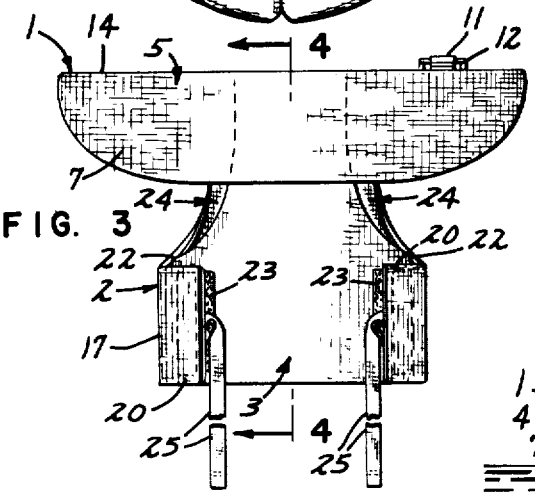
FIG. 3
FIG. 5
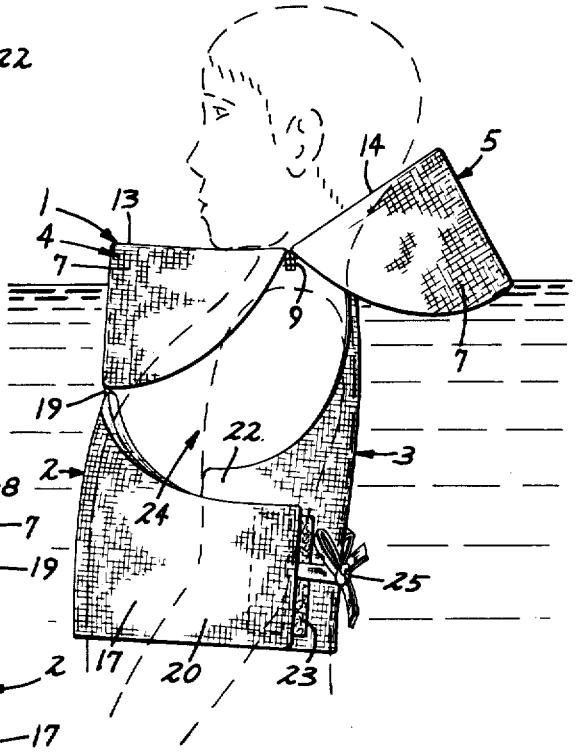
FIG. 4
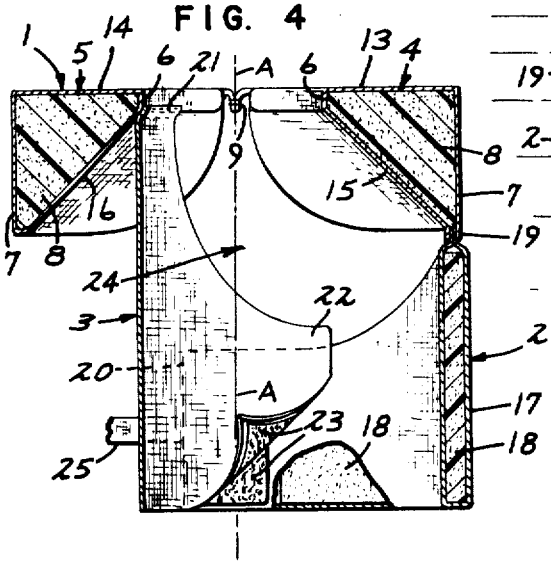

PERSONAL FLOTATION DEVICE

BACKGROUND OF THE INVENTION

This is a continuation-in-part of my co-pending application entitled "Life Preserver Vest" which was filed on Jan. 23, 1975, under Ser. No. 543,407, now U.S. Pat. No. 3,956,786.

The flotation device of this invention is intended primarily for use with small infants weighing less than 30 pounds as well as children weighing from approximately 30 pounds to 50 pounds or more. In producing personal flotation devices for such persons, it is important that, not only the necessary buoyancy be achieved, but also that the device provide positive righting moment. In other words, the device should urge the wearer into a stable generally upright position, wherein the head is supported above the water in a position in which will not restrict breathing and prevended from moving into a face-down position in the water.

SUMMARY OF THE INVENTION

The personal flotation device of this invention includes a collar, a front bib member and a rear back member. The collar comprises a pair of front and rear collar sections each including a buoyant element, the sections cooperating to define a central opening for the neck of the wearer. The collar sections have means for pivotally securing the same together on an axis extending diametrically through the neck receiving opening and transversely of the device. The bib member is also provided with a buoyant element. The bib and back members have lower portions that extend transversely of the device and which are wrapped into overlapping relationship at the sides of the wearer, cooperating with the collar to define armholes. The lower extended portions have fasteners for releasably securing the overlapping parts together. The buoyant elements of the bib member and collar sections cooperate to provide proper positive righting moment to a wearer, to move the wearer toward a generally stable upright position in the water with the wearer's head being supported in a generally head-up attitude.

BRIEF DESCRIPTION OF THE DRAWINGS

FIG. 1 is a view in plan of the personal flotation device of this invention;

FIG. 2 is a view in side elevation;

FIG. 3 is a view in rear elevation;

FIG. 4 is a transverse section taken on the line 4—4 of FIG. 3, some parts being broken away; and FIG. 5 is a view in side elevation, showing the flotation device in use.

DETAILED DESCRIPTION OF THE PREFERRED EMBODIMENT

The personal flotation device of this invention involves a collar 1, generally in the shape of an elliptical or compressed annulus, a front bib member 2, and a rear back member 3, the collar 1 comprising front and rear collar sections 4 and 5 respectively. The collar sections 4 and 5 cooperate to define a central opening 6 for reception of the neck of a wearer. The collar sections 4 and 5 each comprise an outer shell 7 preferably made from textile fabric, such as nylon or other suitable material, and a buoyant or flotation element 8 which may be made from any suitable flotation material, such as closed-cell foam plastics, preferably polyvinyl chloride or polyethylene.

The collar sections 4 and 5 are pivotally secured together on a normally generally horizontal axis that extends diametrically through the neck receiving opening 6 and transversely of the device. At one side of the neck receiving opening 6, the shell portions 7 of the collar sections 4 and 5 are provided with flexible flanges 9 that are stitched or otherwise secured together. Diametrically opposite the stitched together portions of the collar sections 4 and 5, the collar sections are adapted to be releasably secured in substantially abutting pivotal relation by a suitable releasable fastener means such as a pair of flexible straps 10 and 11 stitched or otherwise anchored to respective collar sections 4 and 5, and a cooperating buckle 12 permanently secured to the strap 11 and adapted to be engaged by the strap 10. The collar sections 4 and 5 have generally flat top surface portions 13 and 14, respectively, and respective angular surface portions 15 and 16. The top surface portions 13 and 14 are adapted to be disposed under the chin and back of the head respectively of the wearer, as shown in FIG. 5, the angular surface portions 15 and 16 being adapted to overlie the upper chest and back portions respectively of the wearer. As shown in FIG. 4 and by dotted lines in FIG. 2, the angular surfaces 15 and 16 extend to the outer peripheral portions of their respective collar sections 4 and 5, so that the sections 4 and 5 are of substantially greater generally vertical thickness at the outer peripheral portions thereof than at the opening 6.

The bib member 2 comprises a shell 17 of textile fabric enclosing a buoyant or flotation element 18, the bib member 2 having an intermediate upper portion that is secured to the bottom edge of the front collar section 4 at the outer peripheral wall thereof, as indicated at 19. The bib member 2 has a lower portion 20 that extends transversely in opposite directions so as to be partially wrapped around the chest of the wearer.

The back member 3 has an intermediate upper end portion that extends upwardly to the radially inner portion of the rear collar section 5 and is secured thereto adjacent that portion of the opening 6 defined by the rear collar section 5, as indicated at 21 in FIG. 4. Like the bib member 2, the back section 3 is formed to provide transversely extended lower portions 22 adapted to be partially wrapped around the wearer's chest and to be overlapped by the portions 20 of the bib member 2. The portions 20 and 22 are provided with quickly attached and released fastener devices 23 on their extended ends for releasably holding the portions 20 and 22 in overlapped relationship. An example of such fastener devices is a multihook and loop arrangement produced by the Velcro Corporation of New York, N.Y., and marketed under the trademark "Velcro". It will be noted that, when the transversely extended portions 20 and 22 are disposed in their overlapping relationship, the bib and back members 2 and 3 respectively cooperate with the collar 1 to define armholes 24 through which the wearer's arms can comfortably extend. Preferably, and as shown, the side edges of both bib and back members 2 and 3 respectively diverge in downwardly and laterally outwardly extending curves so as to become the upper edges of transversely extended portions 20 and 22. This arrangement enables the flotation device of one given size to fit wearers of different dimensions. When the device is worn by a person of larger chest dimensions, the overlap between the portions 20 and 22 is less than the device worn by a person having smaller chest measurements. The curvature of the above mentioned edges causes the armholes 24 to vary in size in a generally vertical direction when worn by different persons. Thus, when the device is on a smaller person, the smaller dimension of the armholes 24 effectively prevents the device from riding up on the wearer, and keeps the collar in place on the wearer's shoulders, particularly the front collar section 4 substantially against upper portion of the wearer's chest. To further aid in holding the device on the wearer's person, a pair of flexible tie members 25 are each fastened to a different end of the extended portions 20 and are adapted to be tied together behind the lower portion of the back section 3, as shown in FIG. 5.

When a child, wearing the above described flotation device falls into or otherwise enters the water, the flotation elements 8 in the collar sections 4 and 5 cause the child's head to be carried above the water, as shown in FIG. 5. The buoyancy of the flotation element 18 in the bib member 2 provides turning force or positive righting moment to the wearer, to urge the wearer toward a generally upright position in the water whether the body of the wearer is generally straight or assumes a fetal position. The front collar section 4 urges the wearer's head generally upwardly to prevent the wearer's face from being immersed in the water. At the same time, the rear collar section engages the back of the wearer's head to support the head in a generally erect position above the water.

The connection of the bib member 2 to the peripheral portion of the front collar section 4 prevents the front collar section from being pivotally moved upwardly to cover the wearer's face and restrict breathing. The connection of the back member 3 to the rear collar section 5 adjacent the neck receiving opening 6 lends freedom to the rear collar section to swing generally upwardly to support the back of the wearer's head. The generally elliptical outline of the collar 1, wherein the aixs thereof from side to side of the wearer is substantially longer than the axis from front to rear of the wearer, provides a buoyant or flotation arrangement that is highly effective in preventing the wearer's face from being immersed, in the event that the wearer tilts and then rolls to either side. Thus, the head of the wearer will be properly supported above the water. With the buoyancy afforded by the front and rear collar sections 4 and 5, a safety device is provided that not only provides effective personal flotation for the wearer, but also one which may be worn by a small child in comfort and without interfering with free movement of the child at play in or near the water.

It will be noted that, with the buoyant elements arranged as shown, the buoyant element 8 of the front collar section 4 and buoyant element 18 of the bib member 2, are disposed forwardly of the generally vertical axis of the neck opening, this axis being indicated at A—A in FIGS. 2 and 4. The buoyant element 8 of the rear collar section 5 is disposed rearwardly of the axis A—A. In practice, I have found that, to provide for an effective righting moment to move the wearer's face out of the water from a facedown position within a minimum of time, the combined buoyancy of bib member and front collar section should equal approximately five-ninths or slightly more, of the total buoyancy of the device. With this arrangement, the face of an unconscious person is turned up out of the water in a matter of a very few seconds and well before drowning would normally occur. Further, the above-mentioned buoyancy differential between the front and rear portions of the device is not so great as to interfere with normal play or swimming, to an appreciable extent.

While I have shown the back member 3 as being devoid of flotation elements, it will be appreciated that such may be provided if desired or necessary. Further, it will be noted that any one or all of the flotation elements 8 or 18 may be in the nature of hollow members inflated with a suitable gas, if desired. It will be understood that the device is capable of other modifications without departure from the spirit and scope of the invention as defined in the claims.

What is claimed is:

1. A personal flotation device including:

a. a collar comprising a pair of cooperating front and rear collar sections, each including a buoyant element, said sections cooperating to define a transversely generally central opening for reception of the neck of a wearer, said front section having an outer peripheral portion removed from said neck receiving opening;

b. means pivotally connecting said collar sections together on a normally generally horizontal axis extending transversely of the device at said central opening;

c. a front bib member having an upper end secured to the front collar section at said peripheral portion thereof;

d. a rear back member having an upper end secured to the rear collar section at said opening;

said bib and back members having transversely extending lower portions;

f. fasteners on said lower portions for releasably attaching the lower portions of one of said members in overlapping relationship to the lower portions of the other of said members to dispose said members in snugly encompassing relationship to the chest portion of the wearer and provide side portions that cooperate with said collar to define arm holes;

g. and a buoyant element in said bib member, the buoyant elements in said bib member and front collar section together having greater buoyancy than the buoyant element in said rear collar section, so as to bias the body of the wearer toward a generally faceup position with the body normally leaning slightly rearwardly from a vertical position.

2. The personal flotation device defined in claim 1 in which said buoyant elements are so arranged that more than one-half of the total buoyant effect of said buoyant elements is distributed forwardly of the generally vertical axis of said central opening.

3. The personal flotation device according to claim 1 in which said rear collar section has an outer peripheral portion remote from said neck receiving opening, said collar sections being flat topped and of substantially greater generally vertical thickness at said outer peripheral portions than at said neck receiving opening.

4. The personal flotation device according to claim 1 in which said rear collar section has an outer peripheral portion remote from said neck receiving opening, said collar sections having top surfaces that are flat over substantially the entire areas thereof and angularly disposed lower surfaces, said lower surfaces sloping downwardly from said neck receiving opening to the outer peripheries of their respective collar sections, whereby said collar sections are of substantially greater generally vertical thickness at said outer peripheries than at said neck-receiving opening.

5. A personal flotation device including:

a. a collar comprising a pair of cooperating front and rear collar sections, each including a buoyant element, said sections cooperating to define a transversely generally central opening for reception of the neck of a wearer, said front section having an outer peripheral portion removed from said neck receiving opening;

b. means pivotally connecting said collar sections together on a normally generally horizontal axis extending transversely of the device at said central opening;

c. a front bib member having an upper end secured to the front collar section at said peripheral portion thereof;

d. a rear back member having an upper end secured to the rear collar section at said opening;

e. said bib and back members having transversely extending lower portions;

f. fasteners on said lower portions for releasably attaching the lower portions of one of said members in overlapping relationship to the lower portions of the other of said members to dispose said members in snugly encompassing relationship to the chest portion of the wearer and provide side portions that cooperate with said collar to define arm holes;

g. and a buoyant element in said bib member, the buoyant elements in said bib member and front collar section together having approximately five-ninths of the total buoyant effect of all of said buoyant elements, so as to bias the body of the wearer toward a generally face-up position with the body normally leaning slightly rearwardly from a vertical position.

* * * * *